US008178811B2

(12) United States Patent
Berdelle-Hilge

(10) Patent No.: US 8,178,811 B2
(45) Date of Patent: May 15, 2012

(54) METHOD AND APPARATUS FOR SORTING FLAT OBJECTS IN A NUMBER OF SORTING PASSES

(75) Inventor: Peter Berdelle-Hilge, Constance (DE)

(73) Assignee: Siemens Aktiengesellschaft, Munich (DE)

( * ) Notice: Subject to any disclaimer, the term of this patent is extended or adjusted under 35 U.S.C. 154(b) by 472 days.

(21) Appl. No.: 12/363,247

(22) Filed: Jan. 30, 2009

(65) Prior Publication Data

US 2009/0211952 A1 Aug. 27, 2009

(30) Foreign Application Priority Data

Jan. 30, 2008 (DE) ..... 10 2008 006 752

(51) Int. Cl.
*B07C 5/00* (2006.01)

(52) U.S. Cl. ..... 209/584; 209/900; 700/224; 700/226

(58) Field of Classification Search ..... 209/583, 209/584, 900; 700/223–226
See application file for complete search history.

(56) References Cited

U.S. PATENT DOCUMENTS 656,620 A * 8/1900 Bammann et al. ..... 534/828
5,097,959 A * 3/1992 Tilles et al. ..... 209/584
5,143,225 A * 9/1992 Rabindran et al. ..... 209/584
5,150,891 A * 9/1992 Svyatsky et al. ..... 271/35
5,353,938 A * 10/1994 LaGrange et al. ..... 209/584
5,363,971 A * 11/1994 Weeks et al. ..... 209/584
5,421,464 A * 6/1995 Gillmann et al. ..... 209/584
5,433,325 A * 7/1995 Levaro et al. ..... 209/584
5,901,855 A * 5/1999 Uno et al. ..... 209/584
6,501,041 B1 * 12/2002 Burns et al. ..... 209/584
6,566,620 B1 5/2003 Lohmann
6,576,857 B1 * 6/2003 De Leo et al. ..... 209/584
6,762,384 B1 * 7/2004 Kechel ..... 209/584
6,822,182 B2 * 11/2004 Kechel ..... 209/584
6,953,906 B2 * 10/2005 Burns et al. ..... 209/584
7,060,928 B2 * 6/2006 Jirsa ..... 209/584
7,112,756 B2 * 9/2006 Hanson ..... 209/584
7,170,024 B2 * 1/2007 Burns et al. ..... 209/584
7,343,219 B2 * 3/2008 Berdelle-Hilge ..... 700/223
7,820,932 B2 * 10/2010 Stemmle ..... 209/583
2002/0125177 A1 * 9/2002 Burns et al. ..... 209/630
2004/0007510 A1 * 1/2004 Kechel ..... 209/584
(Continued)

FOREIGN PATENT DOCUMENTS

CA 2574809 A1 1/2006
(Continued)

*Primary Examiner* — Joseph C Rodriguez
(74) *Attorney, Agent, or Firm* — Laurence A. Greenberg; Werner H. Stemer; Ralph E. Locher

(57) ABSTRACT

In a method and device for sorting a quantity of flat objects, especially of mail items, each object passes at least twice through a sorting system with a number of output devices. In each pass of an object the sorting system determines a destination identification of the object and discharges the object depending on the destination identification determined into one of the respective output devices. In the second sorting pass the sorting system groups all objects which are provided with identifications of the same destination into at least one stack such that each stack contains a number of objects and the objects of each stack at least partly overlap each other. The sorting system transports each stack formed in this manner to one of the output devices and discharges it into this output device.

13 Claims, 4 Drawing Sheets

U.S. PATENT DOCUMENTS

| | | | | |
|---|---|---|---|---|
| 2004/0182759 | A1* | 9/2004 | Jirsa | 209/583 |
| 2004/0245158 | A1* | 12/2004 | Redford et al. | 209/584 |
| 2004/0261366 | A1 | 12/2004 | Gillet et al. | |
| 2005/0038555 | A1* | 2/2005 | Hanson et al. | 700/223 |
| 2005/0040084 | A1* | 2/2005 | Hanson et al. | 209/509 |
| 2005/0205473 | A1* | 9/2005 | Mileaf | 209/584 |
| 2005/0218046 | A1* | 10/2005 | Mileaf et al. | 209/584 |
| 2006/0070929 | A1* | 4/2006 | Fry et al. | 209/583 |
| 2006/0108266 | A1* | 5/2006 | Bowers et al. | 209/584 |
| 2007/0090027 | A1 | 4/2007 | Haselberger et al. | |
| 2007/0215529 | A1 | 9/2007 | Desprez et al. | |
| 2008/0087582 | A1 | 4/2008 | Zimmermann | |
| 2008/0149540 | A1 | 6/2008 | Olivier et al. | |
| 2008/0179225 | A1* | 7/2008 | Bowers et al. | 209/584 |

FOREIGN PATENT DOCUMENTS

| | | | |
|---|---|---|---|
| DE | 693 26 617 | T2 | 1/2000 |
| DE | 10 2004 035 365 | A1 | 2/2006 |
| DE | 102004056696 | B4 | 8/2006 |
| DE | 102005055763 | B3 | 4/2007 |
| EP | 0 999 902 | A1 | 5/2000 |
| EP | 1 425 113 | A1 | 6/2004 |
| WO | 99/07487 | A1 | 2/1999 |
| WO | 03/024628 | A1 | 3/2003 |
| WO | 2006/008087 | A1 | 1/2006 |
| WO | 2006100598 | A1 | 9/2006 |
| WO | 2007057078 | A1 | 5/2007 |

* cited by examiner

FIG. 3

| Delivery Address | | | | Output Device | Stacker Points |
|---|---|---|---|---|---|
| ZA-1 | ZA-2 | ZA-3 | ZA-4 | AE-1 | SB-1 |
| ZA-5 | ZA-6 | ZA-7 | ZA-8 | AE-2 | SB-2 |
| ZA-9 | ZA-10 | ZA-11 | ZA-12 | AE-2 | SB-3 |
| ZA-13 | ZA-14 | ZA-15 | ZA-16 | AE-2 | SB-4 |

METHOD AND APPARATUS FOR SORTING FLAT OBJECTS IN A NUMBER OF SORTING PASSES

CROSS-REFERENCE TO RELATED APPLICATION

This application claims the priority, under 35 U.S.C. §119, of German application DE 10 2008 006 752.0, filed Jan. 30, 2008; the prior application is herewith incorporated by reference in its entirety.

BACKGROUND OF THE INVENTION

Field of the Invention

The invention relates to a method and to a device for sorting a quantity of flat objects, especially mail items.

European patent EP 1425113 B1, corresponding to U.S. Pat. No. 7,060,928, teaches a method for sorting a quantity of flat objects, with each object being provided with a respective identifier of a destination point to which the object is to be transported. Each object passes at least twice through a sorting system with a number of output devices and the sorting system, in each pass of an object, determines the destination identification of the object and discharges the object depending on the destination identification determined into one of the respective output devices. The sorting system distributes the objects in the first sorting pass to a number of output devices so that it discharges each object into that output device which is assigned to the respective destination of the object. After the first pass each object is taken out of the respective output device and fed to the sorting system again. With the objects being fed to the sorting system such that, when they are fed, a mixture of objects from different output devices is avoided and the objects will be fed in accordance with a predetermined feed sequence among the output devices used in the first sorting pass. This document describes how mail items are sorted in accordance with a predetermined order of distribution in a sorting system and each mail item in this case passes through the sorting system a number of times. After each pass, except for the last, the mail items are fed back again to the sorting system. This document further describes how a sorting plan is generated.

Published, U.S. patent application No. 2005/0218046 A1 proposes creating a separate sorting plan for each pass and using it for the respective pass. The first sorting plan makes a distinction between a number of delivery point groups and the mail items for these groups output into different output devices.

European patent EP 0999902 B1, corresponding to U.S. Pat. No. 6,566,620, uses a presorting plan and a number of final sorting plans. Each mail item is initially sorted in accordance with the presorting plan, is fed back to the sorting system and subsequently output in accordance with one of the final sorting plans into an output device.

SUMMARY OF THE INVENTION

It is accordingly an object of the invention to provide a method and an apparatus for sorting flat objects in a number of sorting passes which overcomes the above-mentioned disadvantages of the heretofore-known devices and methods of this general type, in which for the second sorting pass with the same number of possible destination points fewer output devices are needed than with known methods.

With the foregoing and other objects in view there is provided, in accordance with the invention, a method for sorting a quantity of flat objects. The method includes the steps of providing each of the flat objects with an identifier of a destination point to which an object is to be transported and passing each of the flat objects at least twice through a sorting system having a number of output devices. The sorting system, in each pass of the object, determines a destination identification of the object and discharges the object depending on the destination identification determined into one of the output devices. Via the sorting system, the flat objects are distributed in a first sorting pass to a number of the output devices so that the sorting system discharges each of the flat objects into a respective one of the output devices which is assigned to the destination point of the object. After a first pass, each of the flat objects is taken out of the respective output device and the flat objects are fed to the sorting system again. The flat objects are fed to the sorting system such that, when they are fed, a mixture of the flat objects from different ones of the output devices is avoided and the flat objects will be fed in accordance with a predetermined feed sequence among the output devices used in the first sorting pass. A second sorting pass is performed in the sorting system, with the steps of: collecting all the flat objects which are provided with the identification of the same destination point into at least one stack such that the stack includes a number of the flat objects and the flat objects of the stack at least partly overlap; and transporting the stack formed in this way to one of the output devices and discharging the stack into the output device.

In accordance with the solution a quantity of flat objects is sorted. Each object is provided with an identification and a destination point to which the object is to be transported.

Each of these objects passes at least twice through a sorting system with a number of output devices.

If an object passes through the sorting system in the first pass, the sorting system executes the now described steps.

It determines the destination point identification of the object.

It discharges the object into one of the respective output devices.

In this case the sorting system distributes the objects to a number of output devices. The sorting system does this by discharging each object into that output device which is assigned to the respective destination point of the object.

Each object is taken after the first pass from the respective output device and fed back to the sorting system again.

When the object is fed back a mixture of objects from different output devices is avoided and the objects are fed in accordance with a predetermined feed sequence among the output devices used for the first sorting run.

The sorting system, when an object passes through the sorting system in the second sorting pass, then executes the now described steps.

It determines the destination point identification of the object.

It groups all objects which are provided with the identifications of the same destination point into at least one stack in each case.

This grouping is undertaken such that each stack contains a number of objects and the objects of each stack at least partly overlap with each other.

If only one object or no object at all is to be transported to a destination point, the sorting system does not form any stack for this destination point.

The sorting system transports each stack formed in this way to one of the output devices and discharges the stack into the output device.

With the known methods, when the sorting system discharges the objects in the first sort pass into N1 output devices and in the second sort pass into N2 output devices, it is able to sort to a maximum of N1*N2 different destination points. By contrast, the inventive method enables sorting to more than N1*N2 different destination points. This is achieved because the objects with the same destination point are grouped into a stack before discharge.

In one embodiment the sorting system in the second pass discharges all objects one after another into the same output device. This output device can simultaneously be that device which is first in the feed sequence which will be emptied in the first sorting pass and thus is the first to become free again.

The flat objects are for example mail items or baggage from travelers or freight items or also flat objects which are to be transported within a production system to different production lines.

In accordance with an added feature of the invention, the sorting system, for the destination point where the object is the only object in a pass which is provided with the destination identification of the destination point, in the second sorting pass transports the object spaced from other one of the flat objects to one of the output devices and discharges the object into the one output device.

In accordance with another mode of the invention, during the second sorting pass the sorting system discharges all stacks in turn into a same output device.

In accordance with a further mode of the invention, during the second sorting pass, the sorting system discharges at least one stack into one of the output devices into which it has discharged at least one object in the first sorting pass.

In accordance with an additional mode of the invention, there is the step of discharging, via the sorting system, all the flat objects which the sorting system has discharged in the first sorting pass into the first output devices of the predetermined feed sequence into the output device in the second sorting pass.

In accordance with a further feature of the invention, the sorting system in the second sorting pass first discharges all the flat objects which the sorting system discharged in the first sorting pass into a same one of the output devices and subsequently the flat objects from a following one of the output device in the predetermined feed sequence are fed to the sorting system.

In accordance with another feature of the invention, the sorting system in the second sorting pass uses a transport path and creates each of the stacks in the transport path and transports the stacks through the transport path to the respective output device. A respective stacker point is predetermined in the transport path for each destination point, so that a sequence of stacker points in the transport path is predetermined. And in the second sorting pass, the sorting system collects at the respective stacker point for the destination point all the flat objects with identifications of the destination point into a stack in each case.

In accordance with an added feature of the invention, the sorting system aborts a grouping into a stack of the flat objects of an identification of the destination point if a parameter of the stack has reached a predetermined limit, and groups further objects with an identification of the destination point into a second stack. Wherein the sorting system counts for each destination point how many objects are provided with an identification of the destination point, and uses a number of the objects of the stack as a parameter of the stack and a maximum number as a limit.

In accordance with another further mode of the invention, there is the step of using a thickness as a parameter of the stack.

In accordance with a concomitant feature of the invention, the sorting system measures the thickness of each of the flat objects before each object becomes an element of the stack, and for each destination point adds a thickness of the flat objects with an identification of the destination point.

Other features which are considered as characteristic for the invention are set forth in the appended claims.

Although the invention is illustrated and described herein as embodied in a method and an apparatus for sorting flat objects in a number of sorting passes, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIG. 3 is a table showing a sorting plan for the sorting system of FIG. 1 and FIG. 2.

DETAILED DESCRIPTION OF THE INVENTION

In the exemplary embodiment the flat objects are flat mail items, e.g. letters, post cards or newspapers. Each mail item is provided with an identification of a delivery address or of another delivery point to which the mail item is to be transported. In one embodiment the identification is attached to the mail item itself. In another embodiment the identification is stored in a database and will be assigned to the mail item. These delivery points function as the destination points of the objects.

Figure 1:
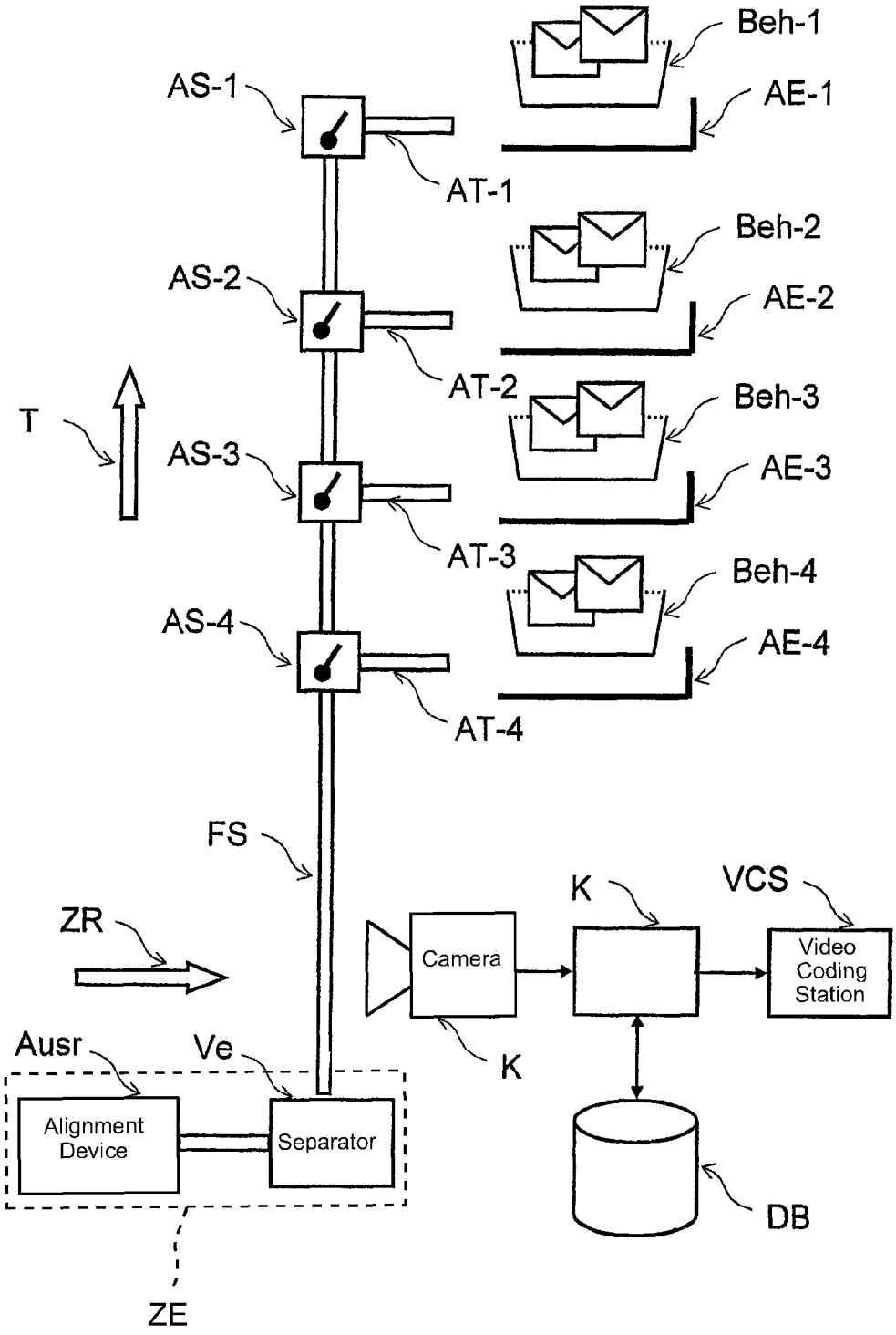
FIG. 1 is a schematic diagram showing components of a sorting system during a first sorting pass.
Figure 2:
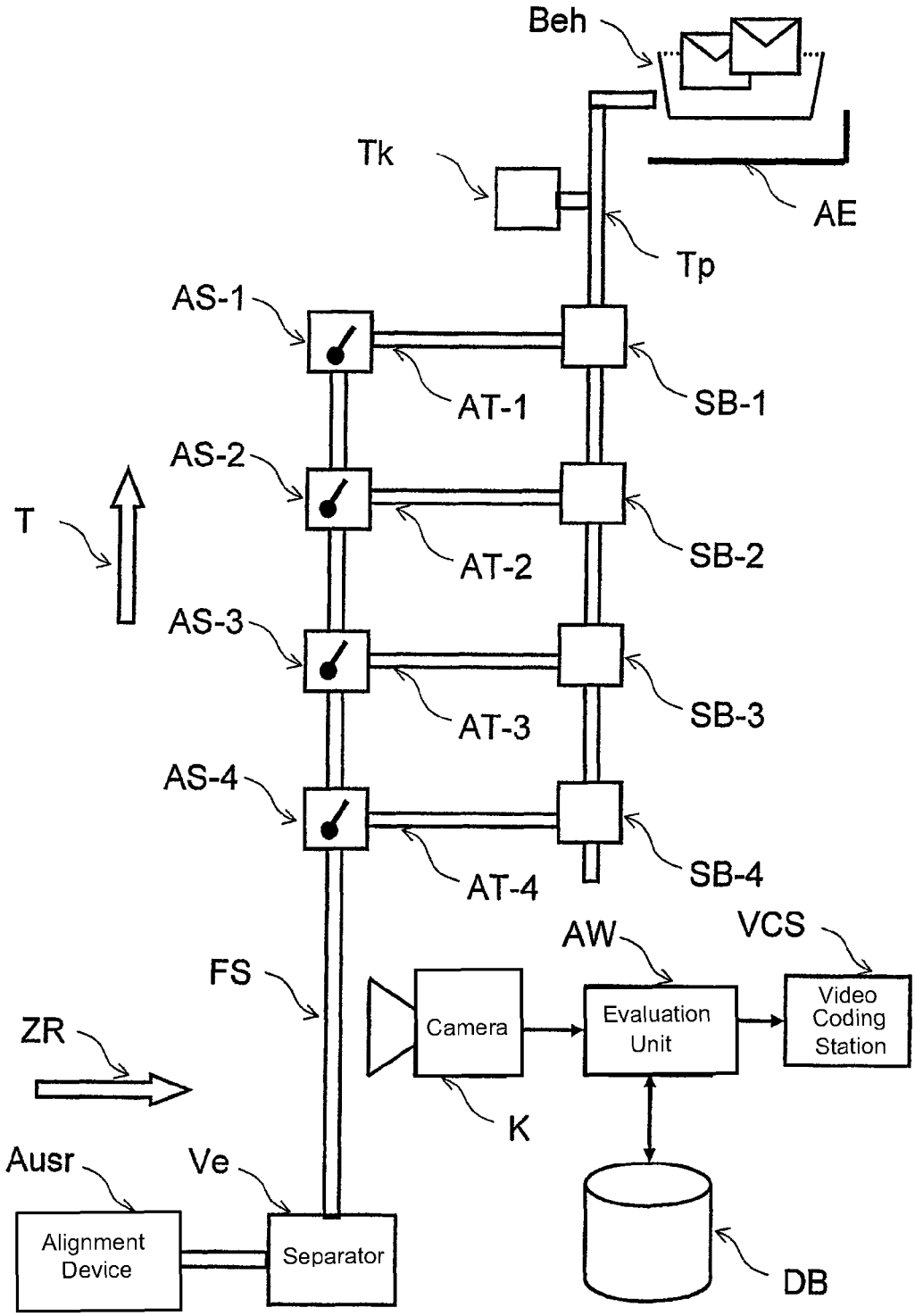
FIG. 2 is a schematic diagram showing components of the sorting system during a second sorting pass.

Each mail item to be transported passes through the same sorting system at least twice—i.e. in two sorting passes—. FIG. 1 shows schematic components of the sorting system for the first sorting pass. FIG. 2 shows schematic components of the sorting system for the second sorting pass.

The sorting system possesses a number of output devices AE1, . . . , AE-4, AE for discharging mail items. An output device can for example contain a supporting surface for a container and the mail items will be discharged into the output device so that the sorting system puts them into a container on the supporting surface. Or the output device has the form of an output compartment into which the sorting system discharges mail items. It is also possible for the output device to contain an output location and a container, for the container to be temporarily linked to the output point and for the sorting device to fill the container. The filled container is removed and replaced by an empty container.

FIG. 1 shows four typical output devices AE-1, AE-2, AE-3 and AE-4. These will be emptied after the first sorting pass with the aid of the containers Beh-1, Beh-2, Beh-3 and Beh-4.

In exceptional cases a mail item only passes through the sorting system once. Such an exceptional case occurs if the mail item is addressed to a recipient of numerous mail items and a separate output device is reserved for this recipient. An exception case also occurs if, during the first pass of a mail item, it is determined that the mail item cannot be machine-processed, i.e. the sorting system cannot process the mail item automatically.

All other mail items pass through the sorting system twice since they are brought by the sorting in a predetermined sequence of distribution ("delivery point sequence") among the delivery address and because there are many more possible delivery addresses than output devices. Thus it is not possible to provide a separate output device for each delivery address in each case. In the exemplary embodiment the sorting system can only discharge a mail item so that the mail item arrives behind an already discharged item but not between two previously selected mail items.

The sorting system contains the now described components.

At least one feed device (feeder) ZE with an alignment device Ausr and a separator Ve, a read device with a camera K, the output devices already mentioned, a transport device with a conveyor FS and a specific transport path Tp, which leads to one of the identified output devices AE, and an evaluation unit AW with a database DB.

A stack with postal items is repeatedly placed on a conveyor belt of the feed unit ZE. The stack originates for example from another sorting system or a post office or from a mailbox. The conveyor belt transports the stack in a feed direction ZR initially to the alignment device Ausr and subsequently to the separator Ve. The separator Ve extracts each mail item from the stack individually, and does so in a direction at right angles to the feed direction ZR.

The transport device transports each mail item in turn to different processing devices of the sorting system. Preferably the transport device contains a system of driven endless conveyor belts. Two conveyor belts in each case clamp an upright mail item—or also a stack of upright mail items which partly overlap—temporarily between them and transport the mail item or the stack, with the two conveyor belts turning at the same speed. The transport device can have additional underfloor conveyor belts on which the mail items stand.

The camera K of the read device creates a processable image of each mail item. This image contains an image of the delivery address identification. The evaluation unit AW of the read device initially attempts to read the delivery address automatically by using "Optical Character Recognition" to find and evaluate the delivery address identification. If it is not successful, the image of the mail item is sent to a video coding station VCS and an operator enters the delivery address—or at least a part thereof, e.g. the Zip code.

Depending on the delivery address recognized, the sorting system discharges each mail item into one of the output devices AE-1, AE-2, AE-3, AE-4, AE. This contains the step of the transport device transporting the mail item to the respective output devices. In the example the mail item is initially transported in the first sorting run onto the conveyor FS. Depending on the delivery address, one of the four discharge switches AS-1, AS-2, AS-3 and AS-4 discharges the mail item onto one of the four discharge transport paths AT-1, AT-2, AT-3, AT-4. Via the respective discharge transport path the mail item arrives at one of the output devices AE-1, AE-2, AE-3 or AE-4.

As already mentioned, each mail item passes at least twice through the sorting system. In the exemplary embodiment the first sorting pass is fully completed before the second sorting pass begins.

The sorting system evaluates a sorting plan available for processing. The sorting plan defines at least the following now described items.

For each possible delivery address the output device into which the mail items addressed to this delivery address are to be discharged in the first sorting pass.

A feed sequence among the output devices which defines the sequence in which the output devices are to be emptied and the mail items from these output devices are to be fed back to the sorting system.

For each output device and for the delivery addresses which are assigned to these output devices, a discharge sequence in each case which is taken into account in the second sorting pass.

An assignment of delivery addresses to stacker points which is explained below.

FIG. 3 shows a sorting plan for the sorting system of FIG. 1 and FIG. 2. In this example 16 possible delivery addresses ZA-1, . . . , ZA-16 are distinguished. The lines assign each of these 16 delivery addresses to a respective output device for the first sorting pass. For example each of the delivery addresses ZA-5, ZA-6, ZA-7 and ZA-8 is assigned to the output device AE-2. In addition the sorting plan defines as the feed sequence the sequence AE-1, then AE-2, then AE-3 and then AE-4, among the output devices.

For the second sorting pass the sorting plan of FIG. 3 defines the now described discharge sequence.

The mail items which are discharged in the first sorting pass into AE-1 are discharged in the discharge sequence ZA-1, ZA-2, ZA-3, ZA-4.

After the two sorting runs the mail items are sorted according to their delivery addresses such that the feed sequence among the output devices and among the delivery addresses of an output device the discharge sequence of the sorting plan is adhered to.

The sorting plan of FIG. 3 causes the mail items to be discharged after the second sort pass in the global order of distribution ZA-1, ZA-2, . . . , ZA-16.

In one embodiment all mail items will be discharged in the second sorting pass into the same identified output device AE. This embodiment facilitates the transporting away of the discharged mail item. This is because the one identified output device AE only needs to be emptied if a predetermined fill level is reached. Until this time the sorting system can conduct the second sort pass automatically without a full output device interrupting the sequence. However it is also possible to empty the identified output device AE beforehand, e.g. if all mail items of the quantity addressed to a predetermined delivery area which consists of a number of delivery addresses have been discharged into the identified output device AE and the transport to this delivery area is to begin immediately.

In the first sorting the mail items pass through the sorting system with an unpredictable sequence among the delivery addresses. The mail items originate for example from other sorting systems or from mailboxes of reception points, e.g. post offices. In both sorting passes all mail items of a quantity are processed, e.g. all mail items which are supplied within a predetermined period and a predetermined district.

In one embodiment, for each delivery address the sorting system counts how many mail items addressed to this delivery address pass through the sorting system in the first sort pass. After completion of the first sorting pass the sorting system "knows" for each delivery address how many mail items are to be transported to this delivery address in each case.

In one variation the thickness of each mail item is measured in addition or instead. For each delivery address the sorting system adds the thicknesses of the mail items addressed to this delivery address. After completion of the first sorting pass the sorting system knows the overall thickness of the mail items addressed to this delivery address.

The sorting system uses the numbers or the total thicknesses of the stack in the second sorting pass in order to avoid creating stacks which are too thick and thereby the occurrence of congestion in the conveyor device. It is also possible to measure the thickness of each stack directly.

In order to empty the output devices and feed the mail items to the feed unit again a transfer bridge is used in one embodiment. Such a transfer bridge is known for example from European patent EP 0634957 B1 (corresponding to U.S. Pat. No. 5,421,464), German patent DE 4236507 C1 (corresponding to U.S. Pat. No. 5,353,903) and European patent EP 1608470 B1 (corresponding to U.S. Pat. No. 7,080,739). It is also possible to empty each output device manually and to transport the mail items in containers to the feed unit for example.

The mail items pass through the feed unit in the second pass precisely as they do in the first pass. The mail items are separated. Subsequently the sorting system determines the respective delivery address of each mail item.

It would be very impractical for the read device to have to read the delivery address again for the second sorting pass. The classical method of avoiding this is for the sorting system to print a delivery address code during the first sorting pass onto the mail item, e.g. in the form of a bar code. In the second sorting pass the sorting system reads the bar code. Each further new sorting system through which the mail item passes also reads the bar code.

Frequently however there is no desire to provide a mail item with a bar code. An agreement of the Universal Postal Union (UPU) makes provision for international mail items not to be provided with a bar code since as a rule different postal service providers use different systems of encoding.

Thus in the exemplary embodiment a method is employed which is has become known as a "fingerprint" or also "virtual ID" and is described for example in German patent DE 4000603 C2 and European patent EP 1222037 B1 and which enables the sorting system to determine that delivery address which was read during the first pass, without use of a bar code, without having to read it again and without printing a bar code on it.

In the exemplary embodiment different features of a mail item are predetermined, which can be measured from outside while the mail item is passing through the sorting system. Examples of such features are dimensions of the mail item, the distribution of gray values and/or color tones on a surface of the mail item, the position and dimensions of the franking mark, the position and size of the address block and/or the sender's details as well as parameters of the delivery address, e.g. the zip code.

In the exemplary embodiment the sorting system has a measurement database DB. As soon as a mail item passes through the sorting system for the first time, the evaluation unit AW generates a data record for the mail item and stores it in the central database. The data record includes a unique identifier of the mail item, the destination address which the first sorting system has read, as well as optionally further parameters of the mail item, e.g. its weight or its franking.

The identifier distinguishes the mail item from all other mail items passing through the sorting system within a specific period. The period of time is three hours for example.

During the first pass the sorting system measures for each mail item which passes through the sorting system and for each predetermined feature the value which this feature assumes for this mail item. This means that during the first pass the sorting system creates a feature vector for the mail item. For N features this feature vector consists of N feature values. The data record for the mail item also includes the feature vector as well as the delivery address.

Whenever the mail item passes through a sorting system again, this sorting system once again measures for each feature the respective value which the feature assumes for this mail item. The sorting system thus likewise creates a feature vector for the mail item which consists of N feature values. This second feature vector will be compared with the feature vectors of data records which are stored in the database DB. This process finds the data record which was created during the first pass of the mail item through the sorting system and originates from the same mail item. The sorting system uses the delivery address of this data record as the delivery address to which this mail item is to be transported.

Each mail item is subsequently transported during the second pass through the sorting system to a specific transport path Tp. The steps of determining the read result and transporting the mail item can overlap in time. In one embodiment the sorting system activates this transport path Tp separately for the second sorting pass, while it is not used for the first sorting pass. The transport path Tp leads in the exemplary embodiment to the one identified output device AE which is used in the second sorting pass.

It is possible for the identified output device AE to which the transport path Tp leads to be that output device AE-1 which, in accordance with the feed sequence, is the first to be emptied after the first sorting pass. The first output device AE-1=AE is also used in both sorting passes. The emptying of the first output devices AE-1 is completed before the stack with the mail items is discharged once more from this output device AE-1 in the second sorting pass. Thus this output device AE-1=AE can be used both in the first and also in the second sorting pass.

A number of stacker points SB-1, SB-2, SB-3, SB-4 are provided in the transport path. Each stacker point is assigned a number of delivery addresses by the sorting plan. The delivery addresses to which the same output device is assigned for the first sorting pass are assigned different stacker points in pairs, i.e. no two of these delivery addresses the same stacker point. The discharge sequence which predetermined the sorting plan for the delivery addresses of the same output devices is the same as the sequence among the stacker points for these delivery addresses. The discharge sequence thus defines the order among the stacker points.

In the second sorting pass those mail items initially pass through the sorting system which are taken according to the first sorting pass from that output device AE-1 which occurs as the first device in the feed sequence. As already stated, the sorting system determines the delivery address of each of these this mail items from AE-1. Depending on the delivery address the sorting system determines the stacker point for this mail item. The sorting system discharges the mail item from the stacker point into the transport path Tp.

Figure 4:
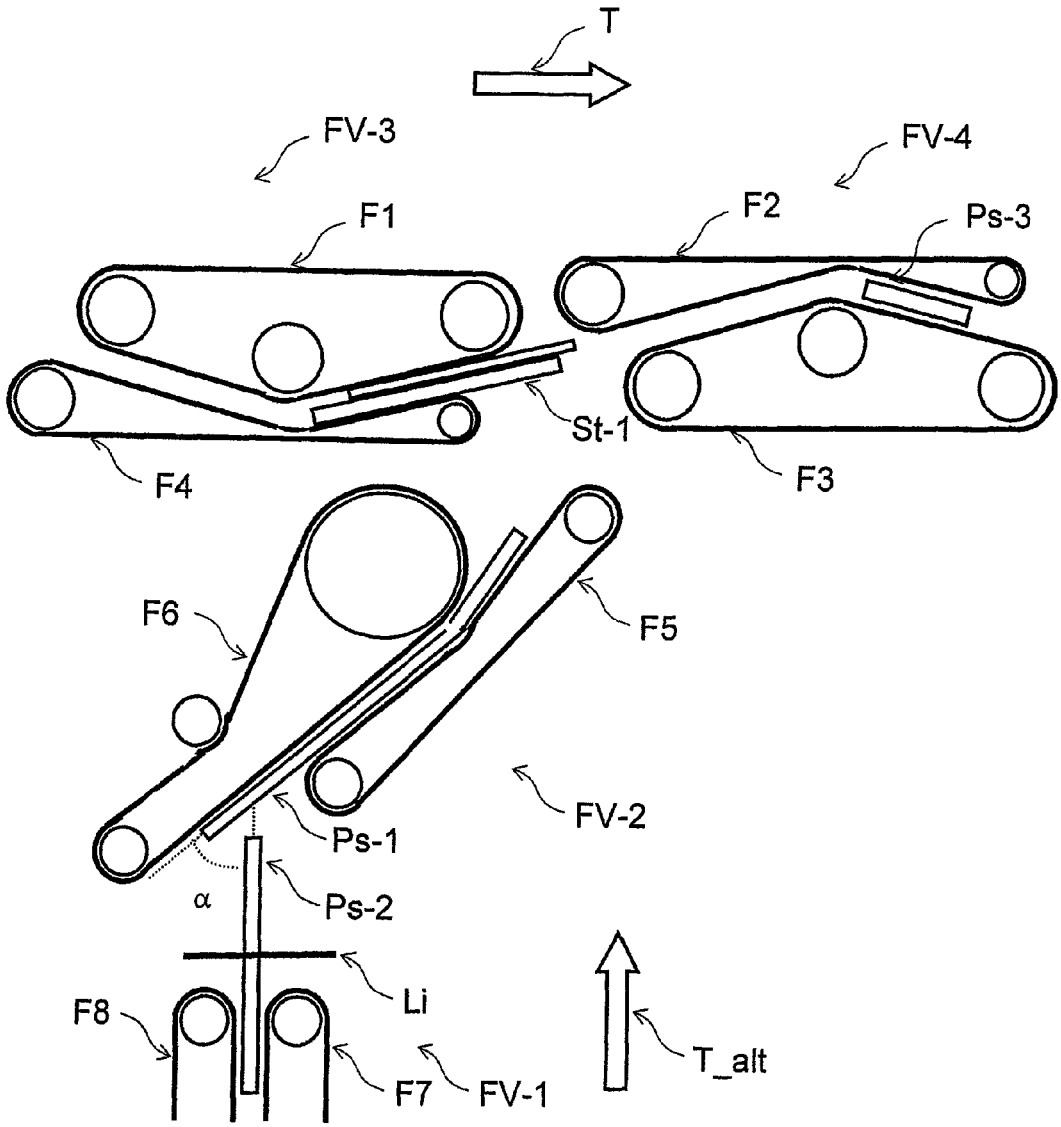
FIG. 4 is a schematic diagram of a stacking device.

FIG. 4 shows schematically the stacker point SB-1 with a stacking device. This example shows the following conveyor devices: a first conveyor device FV-1 with the two driven endless conveyor belts F7 and F8; a second conveyor device FV-2 with the two driven endless conveyor belts F5 and F6; a third conveyor device FV-3 with the two driven endless conveyor belts F1 and F4; and a fourth conveyor device FV-4 with the two driven endless conveyor belts F2 and F3.

The first conveyor device FV-1 belongs to the incoming discharge transport path AT-1 of FIG. 2. The second conveyor device FV-2 is a component of the first stacker SB-1. The third conveyor device FV-3 and the fourth conveyor device FV-4 lie in the transport path Tp.

There is already a sequence of mail items in the transport path Tp, preferably in the form of further small stacks, between which a gap occurs in each case. These small stacks come from other stacker points, the mail items of these other small stacks were discharged via other discharge transport paths.

The small stack of the stacker point SB-1 is to be inserted into a gap between other stacker points in the transport path Tp. Individual mail items are also transported in transport path Tp, because these are too thick to be collected into a small stack for example.

In the example depicted in FIG. 4 a small stack St-1 and an individual mail item Ps-3 are located in the transport path Tp. After all small stacks with mail items addressed to the respective delivery addresses have been formed, the sorting system transports in turn in the direction of conveyance T the individual mail items Ps-3, the small stacks with Ps-1 and Ps-2 and the small stack St-1.

The two mail items Ps-1 and Ps-2 are to be grouped beforehand into a small stack and to be inserted between the small stack St-1 and the further mail item Ps-3. After the insertion the mail items should be transported so that there is a gap both between the mail item Ps-3 and the small stack with the mail item Ps-1 and Ps-2 and also between the small stack and the further small stack St-1.

With the aid of a light barrier in the incoming discharge transport path AT-1 the length of the first small stack to be inserted is also determined. If this length of the small stack has reached a predetermined length barrier, a further stack is preferably formed.

The operation of the stacker device SB-1 is described in below in greater detail with reference to FIG. 4.

The stacker device SB-1 which is shown in FIG. 4, contains the conveyor belts F5 and F6 and the rollers around which these two conveyor belts F5 and F6 are guided. The incoming discharge transport path AT-1 is formed inter alia by the conveyor belts F7 and F8. This transport path opens out into a further transport path, namely the transport path Tp for identified output devices AE, which contains the conveyor belts F1, F2, F3 and F4 and in which a small stack St-1 is already located.

In one embodiment the mail items are diverted while they are passing through the stacker device SB-1. The direction of conveyance in which they are transported is thus changed by an angle $\alpha$ which preferably lies between 30 degrees and 60 degrees, e.g. it is equal to 45 degrees.

A preceding mail item Ps-1 is transported by a first conveyor device FV-1 (endless conveyor belt and opposing conveyor element) in the old direction of conveyance T alt, and is transported until the point at which the mail item Ps-1 is gripped by a second conveyor device FV-2. In the example depicted in FIG. 4 the first conveyor device FV-1 contains the conveyor belts F7 and F8. A second conveyor device FV-2 contains the conveyor belts F5 and F6. The second conveyor device FV-2 diverts the mail item Ps-1 by the angle $\alpha$ into the new direction of conveyance and transports the mail item Ps-1 far enough for it no longer to be gripped by the first conveyor device FV-1 (with F7 and F8). Subsequently the second conveyor device FV-2 stops or slows down the further transport of the preceding mail item Ps-1. This requires the mail item Ps-1 to no longer be gripped by the first conveyor device FV-1, since it would otherwise be clamped by the two conveyor devices FV-1 and FV-2.

The first conveyor device FV-1 transports a subsequent mail item Ps-2 far enough for it to strike the stopped preceding mail item Ps-1 at an angle. During the stopping process the preceding mail item Ps-1—seen in the old direction of conveyance T alt—lies before an endless conveyor belt F6 of the second conveyor device FV-2. This means that the arriving subsequent mail item Ps-2 cannot bend the stopped preceding mail item Ps-1 on arrival, but is diverted because the first conveyor device FV-1 transports the subsequent mail item Ps-2 further in the old direction of conveyance T alt until the second conveyor device FV-2 has caught the subsequent mail item Ps-2.

The second conveyor device FV-2 grips the preceding and the subsequent mail item. These now overlap at least partly. This forms a small stack formed of the preceding mail item Ps-1 and the subsequent mail item Ps-2. The stacker device SB-1 later transports the small stack away in the new direction of conveyance T, with the second conveyor device FV-2 transporting the small stack with Ps-1 and Ps-2 onwards.

The mail items are as a rule rectangular and thus each have a front edge—seen in the direction of conveyance T alt and T. By use of a light barrier Li in the incoming transport path AT-1 the point in time at which the front edge of the preceding mail item Ps-1 and the point in time at which the subsequent mail item Ps-2 passes the light barrier Li are measured. The transport speeds of the two conveyor devices FV1, FV-2 are controlled and are thus also known. The second conveyor device FV-2 transports the preceding mail item Ps-1 far enough in the new direction of conveyance for its front edge to be located in a defined position when the rear edge is no longer gripped by the first conveyor device FV-1. The point at which the front edge of the subsequent mail item hits the stopped preceding mail item Ps-1 thus has a known and adjustable minimum gap from the front edge of the preceding mail item Ps-1. This gap is preferably as small as possible, so that the overall length of the small stack is as small as possible.

Preferably the light barrier Li in the incoming transport path AT-1 also measures the point in time at which the rear edge of the two mail items Ps-1 and Ps-2 pass the light barrier Li. From this information and speed of transport of the first conveyor device Fv-1 and the above-mentioned distance between the front edge of the preceding mail item Ps-1 of the arrival point, the overall length of the small stack now formed with Ps-1 and Ps-2 is computed.

The sorting system initially undertakes the already described formation of stacks for all mail items, which after the first sorting pass were taken out of the first output devices AT-1. The sorting system determines when this stack formation for the mail item is completed for the first output devices AE-1. All these mail items are now distributed on the stack at the stackers SB-1, . . . , SB-4. It is naturally possible for a stack to be formed of only a single mail item, because namely only a single mail item of the quantity is to be transported to this delivery address. It is also possible for there to be no mail items at all at a stacker point, because no mail item is to be transported to the assigned delivery address.

After the sorting system has finished forming the stack for the mail items from the first output device AE-1, the sorting system transports the stack along the transport path Tp. This transport path Tp is also preferably formed by a system of driven conveyor belts. Each stack is clamped at times between two conveyor belts in each case which are turning at the same speed and is transported by this movement. The output conveyor devices FV-3 and FV-4 of transport path Tp can be seen in the example of FIG. 4.

Preferably the gap between two opposite rollers around which the two conveyor belts are fed can be changed, by a roller normally being able to be moved in a direction perpendicular to the direction of conveyance. This adapts the gap to stack thicknesses which vary from small stack to small stack.

The sequence in which the sorting system transports the stack along the transport path Tp is the same as the discharge sequence predetermined by the sorting plan for the delivery addresses of this stack. In this sequence the stacks arrive at the identified output device AE and are discharged in this order into this output device AE. After the discharge the stacks are located in the discharge sequence in the output device AE.

Preferably the sorting system inserts a divider element between two stacks addressed to different delivery addresses, e.g. a divider card. This divider element differs optically and/or by its dimensions from the mail items and in the identified output device AE marks the limits between the two stacks.

FIG. 2 shows a store Tk for divider cards. The divider cards are inserted directly into the store Tk or are inserted via the feed device ZE and via the conveyor path FS and via a specific discharge switch and a specific discharge transport path which leads to the store Tk.

In one variant two identified output devices are used for the second sort pass. Two transport paths lead to these two output devices. The stacker points are divided between these two transport paths and this is done so that the sequence is adhered to. The stacker points for the first half of the discharge sequence are located in the first transport path, those for the second half in the second transport path. The stacks will in turn be discharged in accordance with the discharge sequence into the two output devices.

In one embodiment of this variant the first output device AE-1 of FIG. 1 is used again in the second sort pass as the first identified output device. The other identified output device is an additional output device AE which is only used in the second, but not in the first sorting pass. A first transport path Tp-1 leads to the first identified output device AE-1, a second transport path Tp-2 to the second identified output device AE. The stacker points are distributed between the two transport paths. After the first sorting pass the mail items from the first output device AE-1 are first fed back to the feed device ZE. The first output device AE1 is then empty again, as is the output device AE. In the second sorting pass the sorting system collects these mail items together into small stacks and discharges these via the two transport paths Tp-1 and Tp-2 into the two output devices AE-1 and AE.

After all mail items have been taken out of the first output device of the feed sequence and fed back into the feed device ZE, the same is done with the mail items of the second output device AE-2. The sorting system begins to form the stack for the mail items from the second output device AE-2. At the earliest it begins to do this at the point in time at which it has discharged in the stack with the mail items originating from the first output device into the at least one identified output device, i.e. the second sorting pass is completed for these mail items and these mail items are no longer located in the at least one transport path.

It is not necessary to empty the identified output device AE before this has reached a predetermined fill level. The identified output device AE is only to be emptied after it has reached this fill level. However it is especially possible to collect, mail items in the output device AE which have been discharged after the first sort pass into different output devices.

The invention claimed is:

1. A method for sorting a quantity of flat objects, which comprises the steps of:

providing each of the flat objects with an identifier of a destination point to which an object is to be transported;

passing each of the flat objects at least twice through a sorting system having a number of output devices, the sorting system, in each pass of the object, determining a destination identification of the object and discharging the object depending on the destination identification determined into one of the output devices;

distributing, via the sorting system, the flat objects in a first sorting pass to a number of the output devices so that the sorting system discharges each of the flat objects into a respective one of the output devices which is assigned to the destination point of the object;

after a first pass, taking each of the flat objects out of the respective output device and feeding the flat objects to the sorting system again;

feeding the flat objects to the sorting system such that, when they are fed, a mixture of the flat objects from different ones of the output devices is avoided and the flat objects will be fed in accordance with a predetermined feed sequence among the output devices used in the first sorting pass;

performing a second sorting pass in the sorting system, with the steps of:

collecting all the flat objects which are provided with the identification of the same destination point into at least one stack such that the stack includes a number of the flat objects and the flat objects of the stack at least partly overlap; and transporting the stack formed in this way to one of the output devices and discharging the stack into the output device.

2. The method according to claim 1, wherein the sorting system, for the destination point where the object is the only object in a pass which is provided with the destination identification of the destination point, in the second sorting pass transports the object spaced from other one of the flat objects to one of the output devices and discharges the object into the one output device.

3. The method according to claim 1, which further comprises during the second sorting pass the sorting system discharges all stacks in turn into a same output device.

4. The method according to claim 1, which further comprises during the second sorting pass, the sorting system discharges at least one stack into one of the output devices into which it has discharged at least one object in the first sorting pass.

5. The method according to claim 4, which further comprises discharging, via the sorting system, all the flat objects which the sorting system has discharged in the first sorting pass into the first output devices of the predetermined feed sequence into the output device in the second sorting pass.

6. The method according to claim 1, wherein the sorting system in the second sorting pass first discharges all the flat objects which the sorting system discharged in the first sorting pass into a same one of the output devices and subsequently feds the flat objects from a following output device in the predetermined feed sequence to the sorting system.

7. The method according to claim 1, wherein the sorting system in the second sorting pass uses a transport path and creates each of the stacks in the transport path and transports the stacks through the transport path to the respective output device.

8. The method according to claim 7, which further comprises predetermining a respective stacker point in the transport path for each said destination point, so that a sequence of stacker points in the transport path is predetermined, and in the second sorting pass the sorting system collects at the respective stacker point for the destination point all the flat objects with identifications of the destination point into a stack in each case.

9. The method according to claim 1, wherein the sorting system aborts a grouping into a stack of the flat objects of an identification of the destination point if a parameter of the stack has reached a predetermined limit, and groups further objects with an identification of the destination point into a second stack.

10. The method according to claim 9, wherein the sorting system counts for each said destination point how many said objects are provided with an identification of the destination point, and uses a number of the objects of the stack as a parameter of the stack and a maximum number as a limit.

11. The method according to claim 9, which further comprises using a thickness as a parameter of the stack.

12. The method according to claim 11, wherein the sorting system measures the thickness of each of the flat objects before each said object becomes an element of the stack, and for each said destination point adds a thickness of the flat objects with an identification of the destination point.

13. A sorting system for sorting a quantity of flat objects, with each of the flat objects provided with a respective identifier of a destination to which each object is to be transported, the sorting system comprising:

a number of output devices configured so that each of the flat objects passes through the sorting system at least twice, with the sorting system configured, for each pass of an object to:

determine a destination identification of the object; and discharge the object depending on the destination identification determined into one of said output devices;

the sorting system in a first sorting pass distributing the flat objects to a number of said output devices so that the sorting system discharges each of the flat objects into said output device which is assigned to a respective destination of the object;

the sorting system further configured so that after the first sorting pass each of the flat objects is taken out of a respective said output device and fed to the sorting system again, with the objects being fed to the sorting system such that, when they are fed, a mixture of the flat objects from different said output devices is avoided and the flat objects will be fed in accordance with a predetermined feed sequence among said output devices used in the first sorting pass; and the sorting system is further configured, in a second sorting pass to group all the flat objects which are provided with the identifications of a same destination into at least one stack in each case such that each said stack includes a number of the flat objects and the flat objects of each said stack at least partly overlap, and to transport each said stack formed in this manner to one of said output devices and discharge said stack into said output device.

* * * * *